United States Patent [19]

Jenkins

[11] Patent Number: 4,658,556

[45] Date of Patent: Apr. 21, 1987

[54] BLOCKING SYSTEM FOR STUD BUILDINGS

[76] Inventor: Floyd J. Jenkins, Rte. #17, Manchester, Me. 04351

[21] Appl. No.: 642,143

[22] Filed: Aug. 20, 1984

[51] Int. Cl.[4] ..... E04B 2/00

[52] U.S. Cl. ..... 52/317; 52/283; 52/320

[58] Field of Search ..... 52/317, 320, 321, 349, 52/351, 417, 364, 604, 750, 126.1, 283, 646

[56] References Cited

U.S. PATENT DOCUMENTS

| | | | |
|---|---|---|---|
| 457,985 | 8/1891 | Eastman | 52/320 R X |
| 498,563 | 5/1893 | Montgillion | 52/317 |
| 613,099 | 10/1898 | Walla | 52/320 |
| 1,412,736 | 4/1922 | Hamilton | 52/317 |
| 1,867,449 | 7/1932 | Eckert et al. | 52/317 X |
| 1,890,921 | 12/1932 | Sturges | 52/320 X |
| 3,873,225 | 3/1975 | Jacobsen et al. | 52/604 X |
| 4,007,570 | 2/1977 | Hunter | 52/317 |
| 4,091,594 | 5/1978 | Yamashita | 52/283 X |
| 4,237,669 | 12/1980 | Hunter | 52/317 X |

FOREIGN PATENT DOCUMENTS

| | | | |
|---|---|---|---|
| 229836 | 6/1960 | Australia | 52/417 |
| 435421 | 2/1912 | France | 52/126.1 |
| 2128286 | 4/1984 | United Kingdom | 52/750 |

*Primary Examiner*—Carl D. Friedman
*Assistant Examiner*—Richard Chilcot
*Attorney, Agent, or Firm*—Daniel H. Kane, Jr.

[57] ABSTRACT

A blocking system or backing system for stud buildings provides expandable and retractable backing spans for placement and fitting between the studs. Each backing span is composed of multiple elements including a first backing element having a stud face for abutting against the web or wider dimension of a stud, and a second backing element for bearing against the first backing element. The first and second backing elements are formed with complementary bearing surfaces and are movable relative to each other with a component of motion in the lateral direction. The relative motion permits expansion and retraction of the backing span for spanning variable spacing between the studs. In the preferred example the backing span further includes a third backing element having a stud face for abutting against the web or wider dimension of an adjacent stud. The second and third backing elements are also formed with complementary bearing surfaces and are movable relative to each other with a component of motion in the lateral direction. Thus, all three backing elements coact or cooperate for expansion and retraction for fitting and spanning the space between studs. The blocking elements may be in the form of complementary wedge shaped pieces with inclined wedge bearing surfaces. For two piece backing spans the backing elements of the backing span are, for example, formed of complementary wedge shaped configuration or, for example, in the configuration of a frame and slide for expansion and retraction analogous to a matchbox or drawer.

32 Claims, 19 Drawing Figures

BLOCKING SYSTEM FOR STUD BUILDINGS

TECHNICAL FIELD

This invention relates to a new blocking system or backing system for stud buildings to provide the backing supports, blocks, or spans between the studs to support wall mounted fixtures.

BACKGROUND ART

Construction of stud buildings, and in particular metal stud buildings, requires the installation of backing spans, supports, or blocks between the studs for structural support of wall mounted fixtures and other wall hung or wall mounted items. The blocking or backing pieces are installed after the steel or other material studs are already in place at intervals generally with 16 inch (40.6 cm) or 24 inch (61 cm) on center spacing. During erection of the steel or other material frame, however, variation inevitably occurs in the spacing of the studs, for example, up to 3 inches (7.6 cm) and greater. Thus, the spacing of studs erected to specifications 16 inches (40.6 cm) on center may actually vary, for example, from 14½ inches (36.8 cm) to 17½ inches (44.5 cm) and greater.

Furthermore, steel and other metal studs are generally manufactured with a three sided cross section, one longer width or wider dimension side referred to as the "web" and two shorter width sides extending from the web referred to as the "flanges" terminating in curled edges. The metal studs are conventionally erected with the webs oriented on the same side in the same direction. However, some of the studs are typically inadvertently reversed during placement further contributing to variation in the spacing between the webs of the studs.

As a result, the blocking pieces or backing pieces must be custom fitted for each metal stud building project. The blocking is cut from dimension lumber such as, for example, 2 inch (5 cm) by 6 inch (15 cm) dimension lumber. The dimension lumber is cut to custom lengths by manually measuring the space between the webs of the metal stud at the desired blocking or backing levels and custom cutting the lengths of wood to fit each space. The blocking or backing is typically installed at different levels of the wall, for example, at 2 feet (61 cm), 4 feet (1.2 m) and 6 feet (1.8 m). The blocking or backing pieces must be secured to the studs flush with the face of the walls to provide a flat bearing framework for the wall and this is generally accomplished by nailing through the metal studs into the blocking pieces, either into the end of the blocking pieces through the webs or into the face of the blocking pieces through the flanges. It is apparent that considerable planning and high labor intensity is necessary to provide adequate blocking or backing according to the conventional custom measuring and cutting manual method.

OBJECTS OF THE INVENTION

It is therefore an object of the present invention to provide a blocking system for stud buildings composed of prefabricated or precut backing spans capable of accommodating the variable spacing between studs which occurs particularly during erection of metal frame buildings.

Another object of the invention is to provide backing spans, supports, or blocks which are expandable and retractable for placement and fitting between studs and for spanning variable spacing between the studs.

A further object of the invention is to provide a blocking system for stud buildings which substantially reduces the high labor intensity and cost of conventional manual methods of blocking or backing installation.

DISCLOSURE OF THE INVENTION

In order to accomplish these results, the present invention provides a blocking system comprising a plurality of expandable and retractable backing spans or stud blocks for placement and fitting between the studs. Each backing span or stud block is composed of multiple pieces, including a first backing or blocking element having a stud face for abutting against the web or wider dimension of a stud, and a second backing element for bearing against the first backing element. The first and second backing or stud block elements are formed with complementary bearing surfaces and are movable relative to each other with a component of motion in the lateral direction. A feature and advantage of this arrangement is that the relative motion permits expansion and retraction of the backing system for spanning variable spacing between the studs.

According to the preferred embodiment, the backing span further includes a third backing or blocking element having a stud face for abutting against the web or wider dimension of an adjacent stud facing the first stud. The second and third backing elements are also formed with complementary bearing surfaces and are movable relative to each other with a component of motion in the lateral direction. Thus, all three backing elements coact or cooperate for expansion and retraction relative to each other to provide a variable span stud block for fitting and spanning the space between studs.

Thus, the blocking system comprises blocking spans composed of two or three articulated, interfitting, mutually cooperating or movable pieces with complementary bearing surfaces. In a preferred form the blocking elements are in the form of complementary wedge shaped pieces with inclined wedge bearing surfaces, which may be, for example, planar, tongue and groove, or beveled bearing surfaces. The first and third backing elements are secured to adjacent studs and have inclined bearing surfaces facing each other, defining between them a double wedge shaped space. The second backing element comprises a double wedge shaped piece having a pair of inclined bearing surfaces for fitting securely into the double wedge shaped space defined by the first and third backing elements.

By this configuration the double wedge shaped backing element which may, for example, be triangular or trapezoidal in shape can penetrate to different depths into the double wedge shaped space between the first and third backing elements to accommodate the variable spacing between the studs. Each of the elements may also be maintained flush with the surface of the wall to provide a flat bearing frame for the wall surface and wall mounted fixtures. In other words, the blocking elements are constructed and arranged to cooperate and provide a vertical penetrable support mounting face behind a wall surface for mounting and supporting fixtures on the wall at locations between studs. Each backing element of a backing span formed with a stud face is secured to the web or wider dimension of a stud by, for example, pegs or dowels which penetrate the web or wider dimension of the stud into the backing element abutting against the stud. The pegs project through the stud not only on one side into the first backing element of a backing span but also project from the other side of the stud for securing a backing element of another backing span on the other side of the stud. A feature and advantage of this arrangement is that the pegs may be automatically injected by a clincher tool designed for that purpose.

The invention also contemplates a variety of alternative backing span configurations and embodiments including two piece backing span configurations and embodiments composed of first and second backing elements movable relative to each other. According to one embodiment, the first and second backing elements are wedge shaped pieces with inclined bearing surfaces for movement relative to each other with a lateral component of motion. According to another configuration, the first backing element is a frame secured to a stud with a second backing element comprising a slide constructed and arranged for sliding and interfitting relationship with the frame so that the slide may be pulled out and pushed in relative to the frame for expansion and retraction of the backing system analogous to a matchbox or drawer.

The invention is applicable to any material stud frame construction but is particularly suitable for steel frame and metal stud construction. However, reference herein and in the claims to the "web" of a stud is intended to refer to the wider cross sectional dimension of the stud whether wood, metal, plastic, or other synthetic or natural materials, etc.

Other objects, features and advantages of the invention will become apparent in the following specification and accompanying drawings.

BRIEF DESCRIPTION OF THE DRAWINGS

FIG. 2A is a side view and FIG. 2B is a top view of the first backing element of FIG. 2, while

FIG. 2E is a perspective view of a dowel peg suitable for securing backing elements of the type illustrated in FIG. 2D to a metal stud; while

FIG. 7 is a side view of the wall surface face of a two piece frame and slide expandable and retractable backing span according to the invention, while

DESCRIPTION OF PREFERRED EXAMPLE EMBODIMENTS AND BEST MODE OF THE INVENTION

Figure 1:
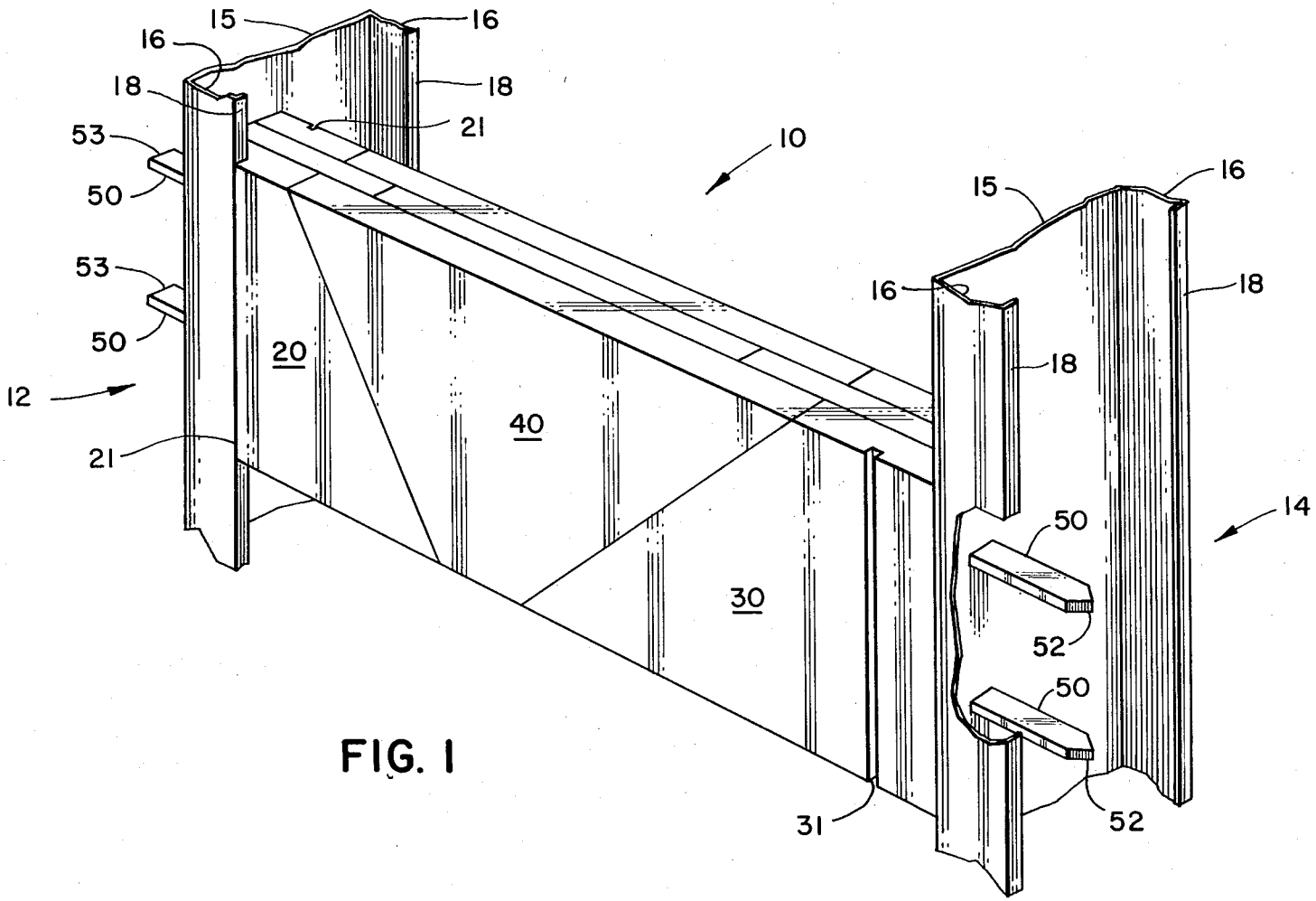
FIG. 1 is a perspective view of three piece backing span composed of three backing elements movable relative to each other and mounted between adjacent metal studs in accordance with the present invention.

A blocking or backing span 10 according to the blocking system of the present invention is illustrated by way of example in FIG. 1 mounted between the metal studs 12 and 14. The backing span 10 fully spans the space between the metal studs 12 and 14 and is mounted flush with the face of a wall to provide a flat bearing frame work for support of wall mounted fixtures and other wall hung or wall mounted items. As illustrated in FIG. 1, each metal stud is generally constructed with a longer width side or web 15 and two shorter width sides or flanges 16 terminating in curled edges 18. The backing span 10 is constructed, arranged, and mounted for fitting between and spanning the space between the webs 15 of the adjacent metal studs 12 and 14 and each end of the backing span 10 is provided with a stud face for abutting against a web 15.

In the preferred embodiment of FIG. 1 the backing span 10 is composed of three wedge shaped backing elements 20, 30 and 40. The first and third backing elements 20 and 30 which abut against the webs 15 of adjacent metal studs 12 and 14 are in the form of single wedge pieces while the second or middle backing element 40 is a double wedge piece in the shape of a trapezoid. As shown in FIG. 1, the stud face of backing element 30 is secured to the web 15 of stud 14 by means of rectangular cross section steel pegs 50 which penetrate through the web 15 into the end of the backing element 30. The pegs are shown projecting on the other side of web 15 for penetrating into the end of the backing element of another backing span, removed for clarity, on the other side of stud 14. The first backing element 20 is similarly mounted by pegs 50 penetrating through the web 15 of metal stud 12.

Each of the single wedge piece backing elements 20 and 30 which are formed with stud faces for butting against the web 15 of a metal stud are also formed on the sides with vertical kurfed grooves 21 and 31 respectively. The kurfed grooves 21 and 31 are spaced a distance from the stud face end of the backing elements 20 and 30 the same distance as the width of the flanges 16 to accommodate the curled edges 18 so that the backing span 10 can be maintained flush with the face or front of the wall. As shown in FIG. 1, all of the single wedge piece backing elements 20 and 30 are formed with the kurfed grooves 21 and 31 respectively on both sides so that the single wedge piece backing elements 20 and 30 are identical, reversible, and interchangeable. By this expedient only two different shaped backing element pieces, namely the single wedge piece and the double wedge piece are required to be manufactured. Furthermore, installation is facilitated because any single wedge piece backing element 20 or 30 may be mounted by the installation worker on either side of the web 15 of a metal stud.

Figure 2:
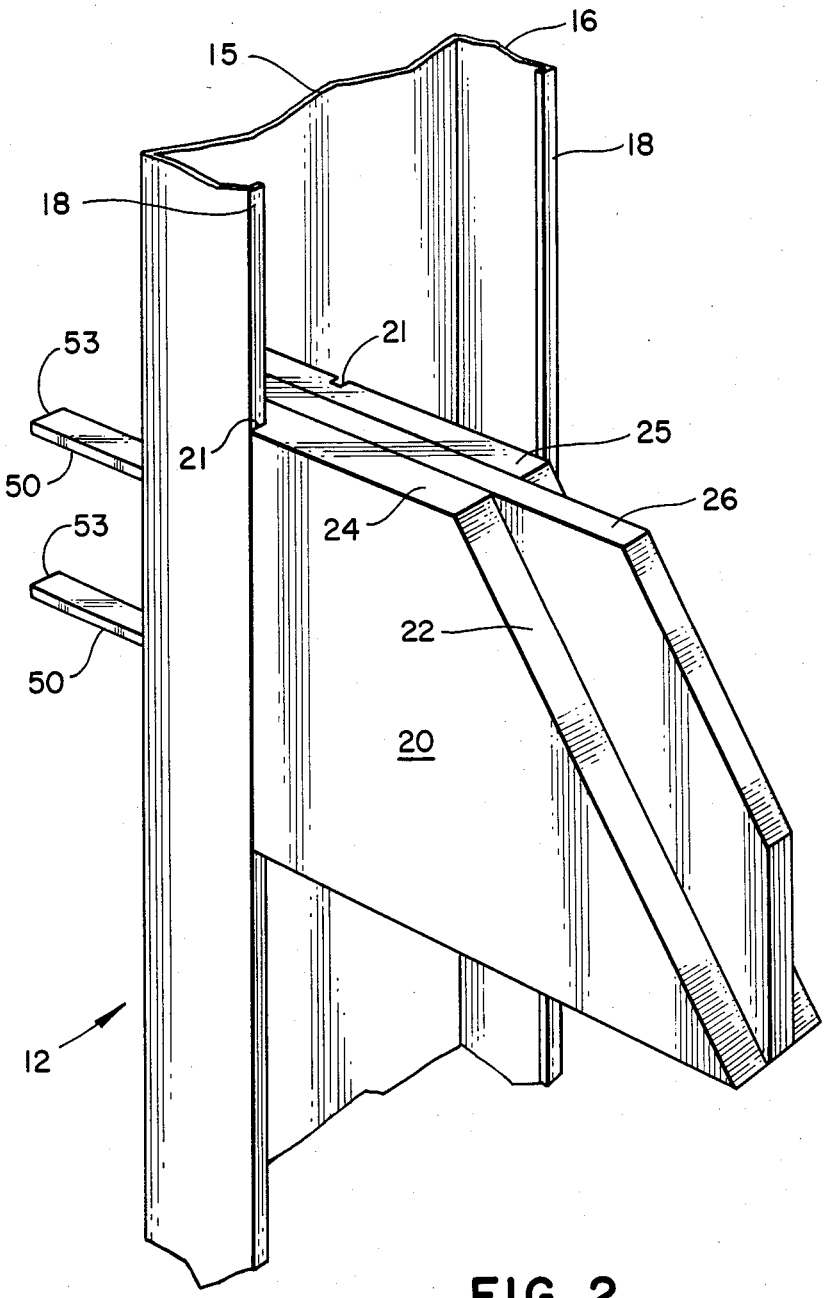
FIG. 2 is a partial perspective view of the first backing element of the backing span separated from the second and third backing elements and secured to the web of a metal stud.

The construction of the single wedge piece backing element 20, identical to the backing element 30 is illustrated in FIGS. 2, 2A, 2B, and 2C. The backing element 20 is shown securely mounted to the web 15 of metal stud 12 by penetrating pegs 50 and is formed with an inclined bearing surface 22 in the configuration of a tongue and groove bearing surface complementary with a tongue and groove bearing surface formed on the double wedge piece backing element 40. The inclined bearing surface 22 may, however, be formed in a variety of configurations, such as a simple inclined plane bearing surface, stepped bearing surface, beveled bearing surface, etc., as hereafter described. In the example of FIG. 2 the backing elements are conveniently manufactured from three laminated plies or sheets of plywood including outer layers 24 and 25 of, for example, ½ inch (1.3 cm) plywood and a center layer 26 of, for example, ⅜ inch (0.95 cm) plywood, all bonded or laminated together. The backing element 20 is conveniently manufactured with the center plywood layer or sheet 26 projecting beyond the outer layers 24 and 25 to form the groove or spline of the inclined tongue and groove bearing surface 22.

Figure 2A:
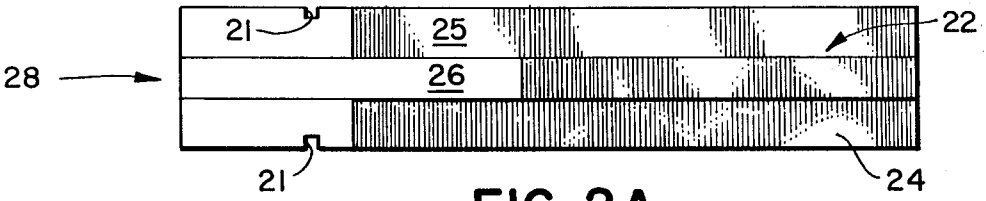
Figure 2B:
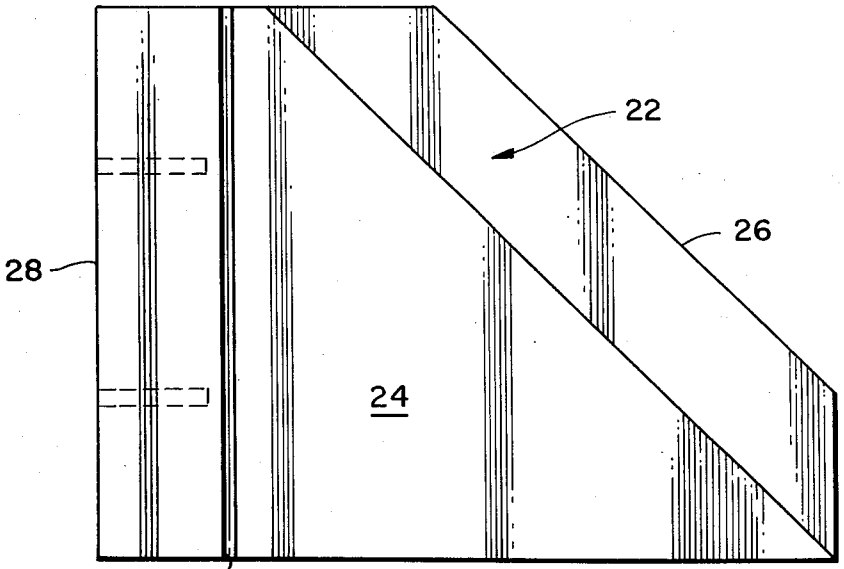
Figure 2C:
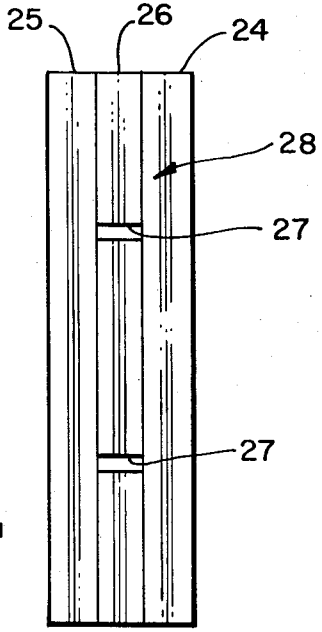
FIG. 2C is an end view looking at the stud face of the first backing element showing square cross section peg holes.

As further appears in FIGS. 2A, 2B, and 2C, each single wedge piece backing element 20 is formed with a flat stud face 28 for abutting against the web 15 of a metal stud. The kurfed grooves 21 permit the backing element 20 to be fitted with the flat stud face 28 abutting against the web 15 on the flange side of the stud and with the front of the plywood layer 24 flush with the face of the wall defined by the metal studs. In the example of FIG. 2C the flat stud face 28 is preformed with two peg holes 27 of rectangular cross section to fit over and receive the mounting pegs 50 shown in FIG. 2F. The rectangular cross section peg holes may be conveniently formed during manufacture of the backing elements by cutting across the central plywood layer 26 at the peg hole locations prior to bonding or laminating of the plywood layers 24, 25, and 26 together. By this expedient the peg holes 27 are preformed with just the right size with a width, for example, of ⅜ inches (0.95 cm) by ⅜ inch (0.32 cm) to accommodate steel pegs 50 of the same cross sectional dimension and, for example, 2 inches long as illustrated in FIG. 2F.

Figure 2D:
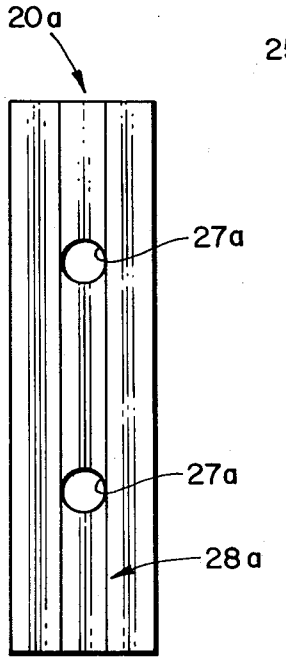
FIG. 2D is an end view looking at the stud face of an alternative first backing element formed with circular cross section dowel peg holes.
Figure 2E:
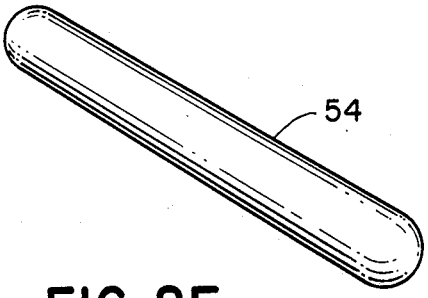
Figure 2F:
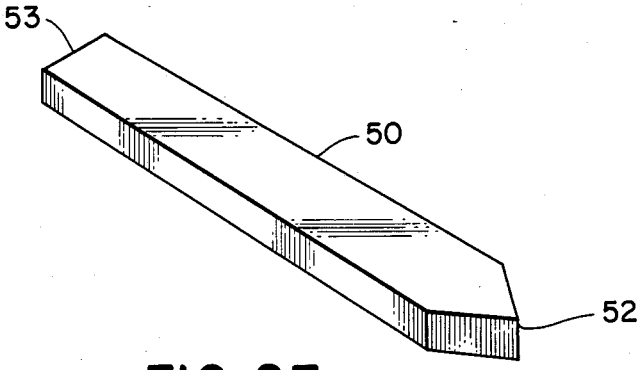
FIG. 2F is a perspective view of a rectangular cross section peg suitable for securing backing elements of the type illustrated in FIG. 2C to a metal stud.

An alternative configuration is shown in FIG. 2D where the flat stud face 28*a* of a backing elements 20*a* is formed with round peg holes 27*a* for accommodating round cross section dowel mounting pegs 24 of the type shown in the FIG. 2E.

Figure 3A:
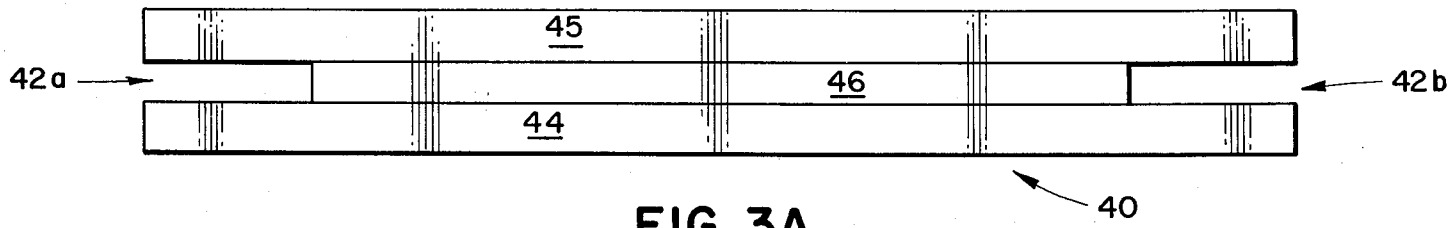
FIG. 3 is a side view and FIG. 3A a top view of the second backing element or center backing element of the backing span shown in FIG. 1.
Figure 3:
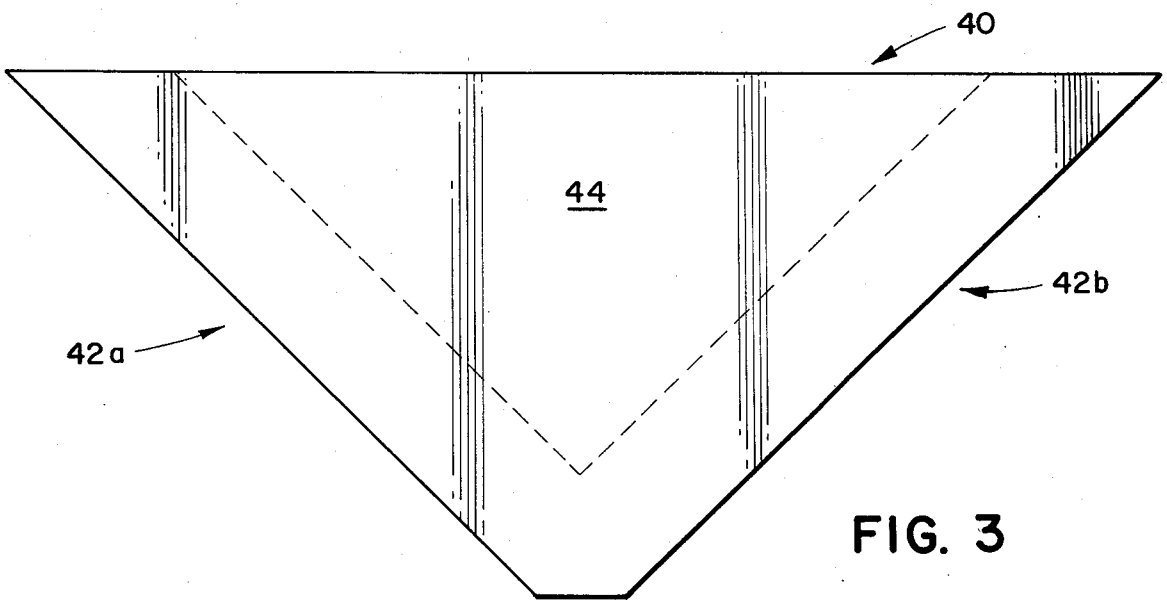

The double wedge piece backing element 40 which fits between the single wedge piece backing elements 20 and 30 of backing span 10 is illustrated in FIGS. 3 and 3A. The backing element 40 is formed with a pair of inclined bearing surfaces 42*a* and 42*b* of tongue and groove configuration complementary with the inclined bearing surfaces 22 of the single wedge piece backing elements 20 and 30. Backing element 40 is similarly constructed, for example, of three plies or layers of plywood with outer layers 44 and 45 of, for example, ½ inch (1.3 cm) plywood, and the middle or center layer 46 of ⅜ inch (0.32 cm) plywood. The backing element 40 is conveniently and inexpensively manufactured by cutting the center ply or layer 46 prior to bonding and laminating of the layers 44, 45, and 46 so that the central layer 46 is recessed to form the groove in each of the inclined bearing surfaces 42*a* and 42*b*. The backing element 40 is of generally trapezoidal or triangular shape.

While the backing span 10 has been described with reference to the foregoing example of backing elements composed of bonded or laminated layers or sheets of plywood, the backing elements may of course also be formed from single pieces of wood or similar material and from both natural and synthetic materials.

Installation of the backing span 10 is described with reference to FIGS. 1 and 2. As shown in FIG. 2, first, the single wedge piece backing element 20 of the backing span 10 is mounted or installed with the backing piece 20 on the flange side of the web 15 of metal stud 12. The curled edge 18 of the metal stud is fitted in and accommodated by the kurfed groove 21 and with the flat stud face 28 of backing element 20 abutting against the web 15. The steel pegs 50 are then injected or impacted by a clincher tool through the web 15 of metal stud 12 penetrating a distance of half the length of the 2 inch (5 cm) pegs into the end of the backing element 20. The pegs illustrated in FIG. 2F are formed with a pointed tip 52 for piercing the web 15 of the metal stud. The pointed tips 52 of pegs 50 are therefore not visible in FIG. 2 and the flat end 53 is visible projecting from the other side of the web 15 for mounting of a similar backing element with precut peg holes on the flat side of web 15.

Continuing on with the installation of backing span 10, reference is made to FIG. 1. The third backing element 30 which is also a single wedge piece backing element is then fitted over the flat projecting ends of steel pegs 50 previously installed and penetrating through the web 15 of metal stud 14 during installation of another backing span to the right of metal stud 14. As shown in FIG. 1, the pointed ends 52 of pegs 50 penetrating through metal stud 14 are visible on the right because of the removal of the backing span to the right for clarity. Thus, the steel pegs 50 through metal stud 14 would properly be hidden if the backing span to the right were actually shown in place.

After the single wedge piece backing elements 20 and 30 are mounted in place between the adjacent metal studs 12 and 14, the double wedge piece backing element 40 may then be inserted in place. The inclined bearing surfaces of backing elements 20 and 30 define between them a double wedge shaped space in which the double wedge piece backing element 40 is fitted with the complementary tongue and groove bearing surfaces bearing against each other.

As shown in FIGS. 1–4, the cooperating backing elements 20, 30, and 40 are constructed and arranged to present a vertical support mounting face, flush with the back of the surface of a wall secured to the studs, to mount and support wall-mounted fixtures on the wall surface at locations between the wall studs. As further illustrated in FIGS. 1–5, the backing elements are constructed with sufficient thickness for nails, screws, and other penetrating elements to provide structural support of brackets and fixtures on the exposed surface of the wall.

Figure 4:
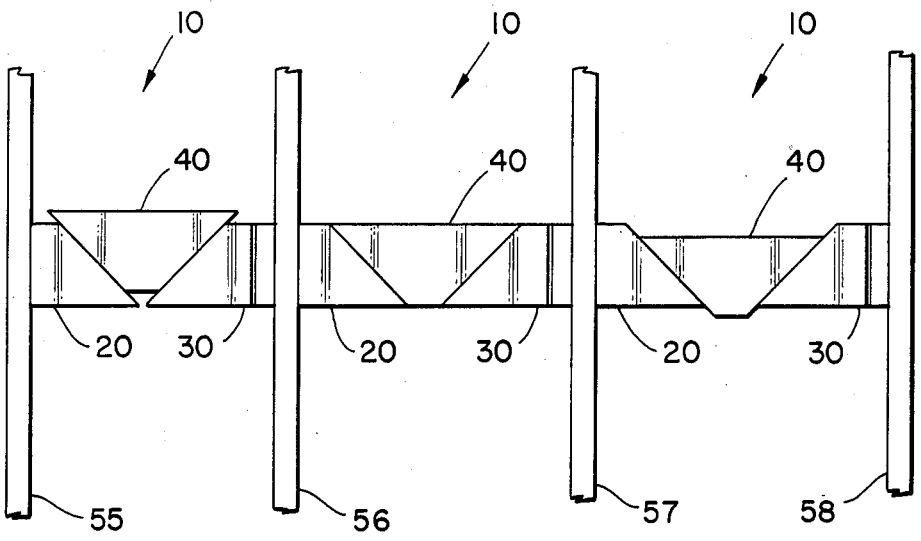
FIG. 4 is a diagrammatic view from the side of a blocking system according to the present invention showing blocking spans of the type illustrated in FIG. 1 between the metal studs of a metal frame with variable spacing between the metal studs.

Referring to FIG. 4, the double wedge piece backing element 40 or middle backing element of the backing span 10 may penetrate the double wedge shaped space defined between the bearing surfaces of backing elements 20 and 30 according to the variable spacing between the metal studs 55, 56, 57, and 58 illustrated in FIG. 4. Typical variation of 16 inch (40.6 cm) on-center spaced studs is shown in this example with the spacing between studs 55 and 56 slightly under 16 inches (40.6 cm), the spacing between studs 56 and 57 exactly at 16 inches (40.6 cm), and the spacing between studs 57 and 58 slightly greater than 16 inches (40.6 cm). For spacing under specification as between studs 55 and 56, the double edge backing element 40 penetrates the space between backing elements 20 and 30 to a lesser depth resting slightly above the upper surfaces of backing elements 20 and 30. With the spacing at specification as shown between studs 56 and 57, the backing element 40 penetrates the space between backing elements 20 and 30 so that the top surfaces are flush. With the spacing exceeding the specification, the blocking element 40 penetrates to a greater depth into the space between blocking elements 20 and 30 so that the top of backing element 40 falls below the top surfaces of backing elements 20 and 30.

Figure 4A:
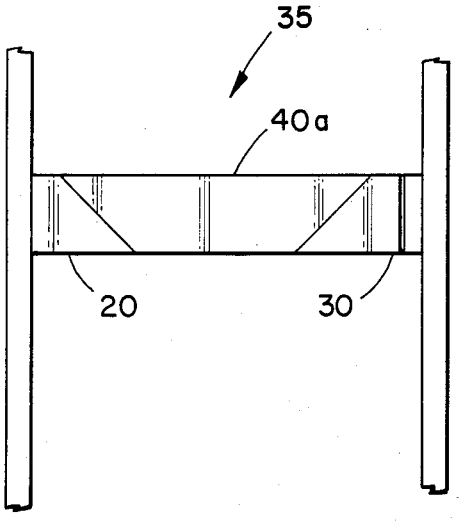
FIG. 4A is a diagrammatic view from the side of a blocking span of the type illustrated in FIGS. 1 and 4 but suitable for metal studs of wider on-center spacing than that illustrated in FIG. 4.

A backing span 35 for spanning the space between metal studs set at wider on-center spacing than that illustrated in FIG. 4 is shown in FIG. 4A. In this example the backing span 35 is constructed to accommodate metal studs set at, for example, 24 inch (61 cm) on-center spacing. The backing span 35 similarly includes three backing elements. The first and third backing elements 20 and 30 are single wedge piece backing elements identical with those shown in FIGS. 1 and 4. The second or middle backing piece element 40*a* is a double wedge piece element similar to the backing element 40 of FIGS. 1 and 4 but formed with a greater width to accommodate the greater span of the 24 inch (61 cm) on-center spacing. Thus, the only difference between the backing span 35 and backing span 10 is the greater width of the trapezoid shaped backing element 40*a* over the backing elements 40.

Figure 5:
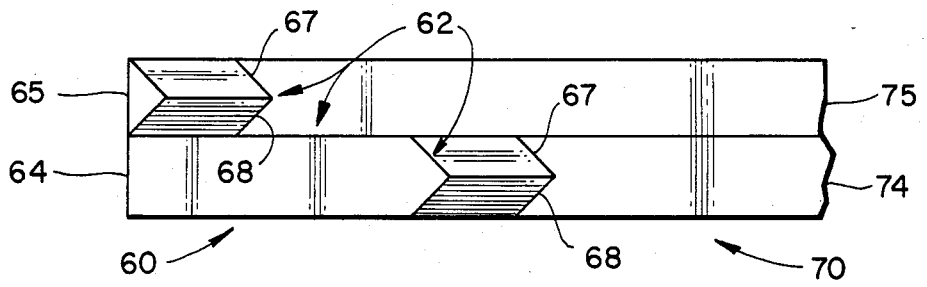
FIG. 5 is a detail fragmentary view of the bearing surfaces of adjacent backing elements of a backing span according to the present invention having inclined double beveled bearing surfaces.
Figure 5A:
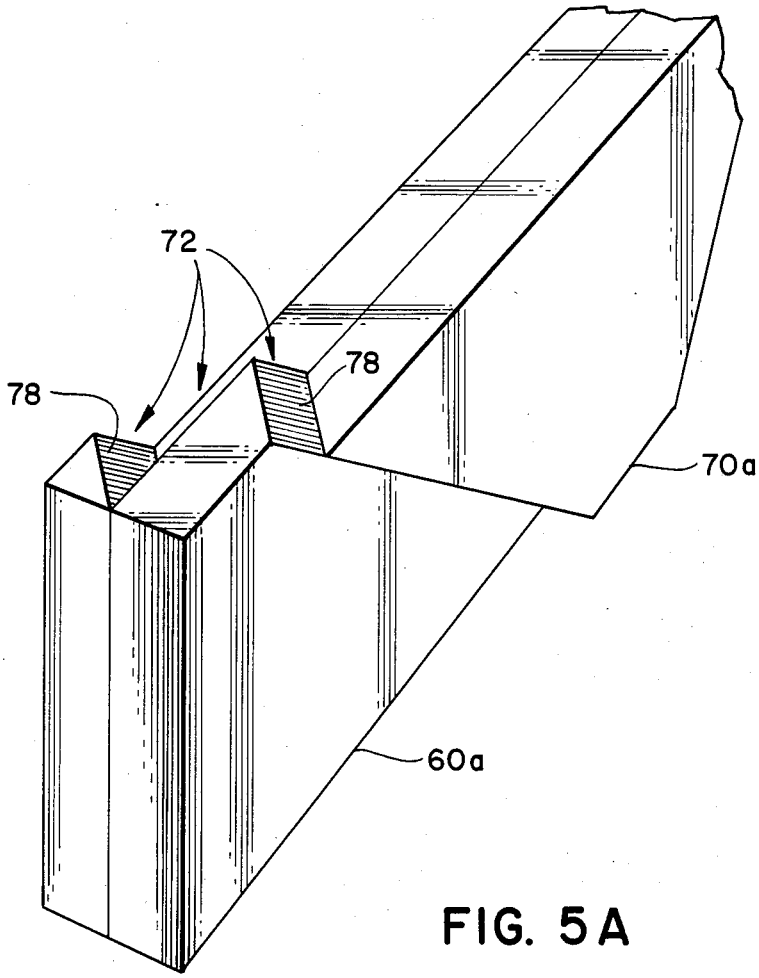
FIG. 5A is a detail fragmentary perspective view of the bearing surfaces of adjacent backing elements of a backing span having inclined beveled and stepped bearing surfaces.

Variations in the configuration of the complementary bearing surfaces of the backing elements and the backing spans are illustrated in FIGS. 5 and 5A. FIG. 5 is a fragmentary view showing the intersecting complementary bearing surfaces between backing elements 60 and 70. Backing element 60 is composed of two plies or layers 64 and 65 of, for example, plywood, while backing element 70 is composed of two layers 74 and 75, also, for example, of plywood. The backing elements 60 and 70 which may be compared, for example, with backing elements 20 and 40 meet along an inclined stepped bearing surface 62. Each of the steps is formed with double bevels 67 and 68 which prevent the backing elements 60 and 70 from separating from each other or sliding sideways away from each other.

Another example of complementary bearing surfaces between blocking elements 60*a* and 70*a* is illustrated in FIG. 5A. In this example the backing elements 60*a* and 70*a* meet at complementary inclined and stepped bearing surfaces 72 in which the steps are each formed with a single bevel 78 so that the combination of the stepped surface and the bevels prevent the two layered or two ply backing elements 60*a* and 70*a* from parting or sliding away from each other.

Figure 6:
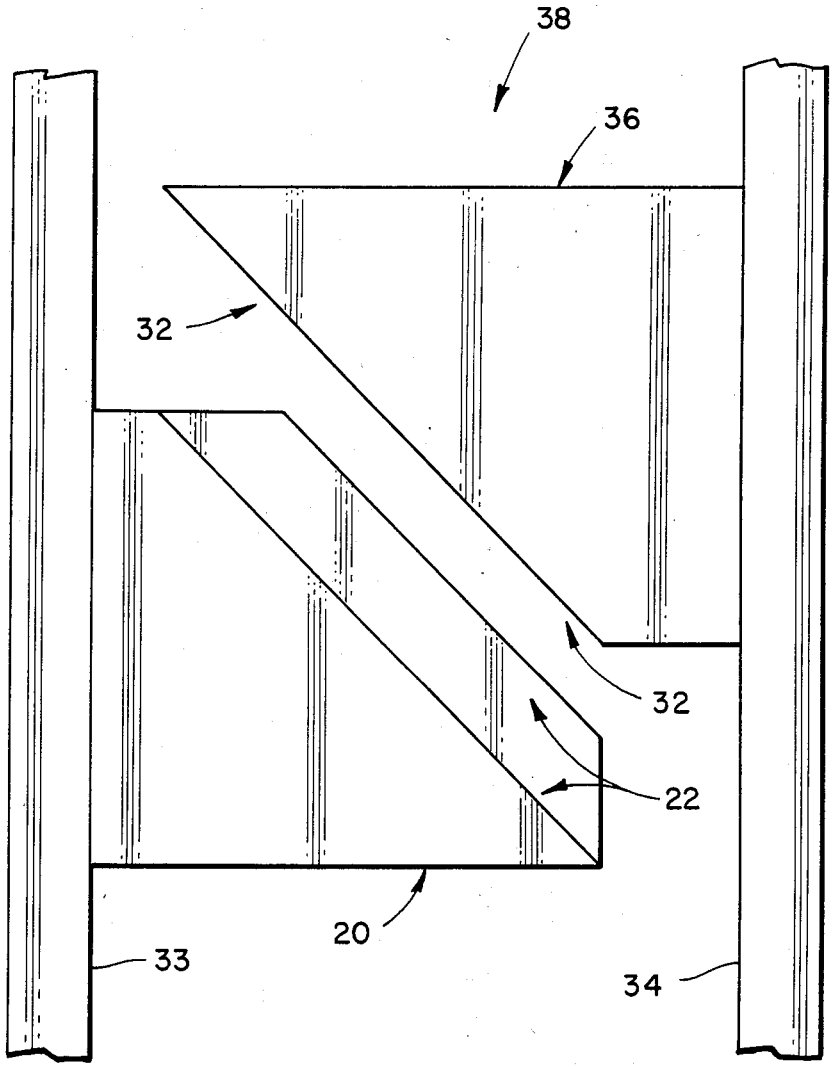
FIG. 6 is a diagrammatic side view of a two piece backing span according to the present invention with the two backing elements disengaged to show the interfitting inclined tongue and groove bearing surface for motion of the two backing elements relative to each other with a lateral component of motion for spanning variable spaces between closely spaced metal studs.

A two piece backing span 38 formed by two single wedge piece backing elements 20 and 36 is illustrated in FIG. 6. The two piece backing span 38 is particularly suited for closely spaced metal studs 33 and 34. The backing element 20 is identical with the single wedge piece backing elements 20 described with reference to FIGS. 1, 2 and 4 and includes the inclined tongue and groove bearing surface 22. Backing element 20 is secured to metal stud 30 in the manner described.

The single wedge piece backing element 36 is similar to backing elements 20 and 30 heretofore described, however, the inclined tongue and groove bearing surface 32 is formed with a complementary groove rather than with a tongue or spline so that the bearing surface 32 is complementary with the bearing surface 22 of backing element 20. Backing element 36 is inverted with the inclined bearing surface 32 facing downward to bear upon surface 22 and is secured with a flat stud face abutting against the web of metal stud 34 after sliding downward to engage the bearing surface 22 of backing element 20 in closely fitting relationship. Thus, single wedge piece backing element 36 descends to variable depth in engaging the bearing surface 22 of backing element 20 according to the variable spacing between the metal studs 33 and 34.

In each of the foregoing examples of FIGS. 1, 4, 5, and 6, the backing span comprises wedge shaped backing elements having complementary inclined bearing surfaces. The backing elements of the backing span are brought into engagement by vertically inserting and engaging the backing elements along the respective bearing surfaces to different depths according to the variable spacing between the metal studs. While the backing elements are initially movable relative to each other for interfitting engagement in the vertical direction, once the complementary bearing surfaces are engaged the inclined or wedge shaped orientation of the bearing surfaces introduces a horizontal or lateral component of motion into the relative motion between the backing elements. It is this horizontal or lateral component of motion in the relative movement of the backing elements which effects the expansion and contraction of the backing span for spanning variable spaces between the metal studs.

Figure 7A:
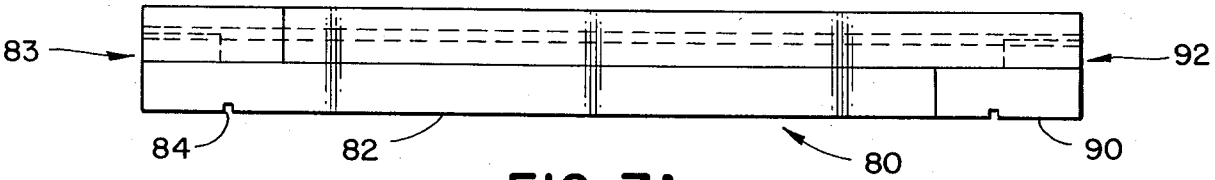
FIG. 7A is a top view and FIG. 7B an end view of the two piece frame and slide backing span.
Figure 7:
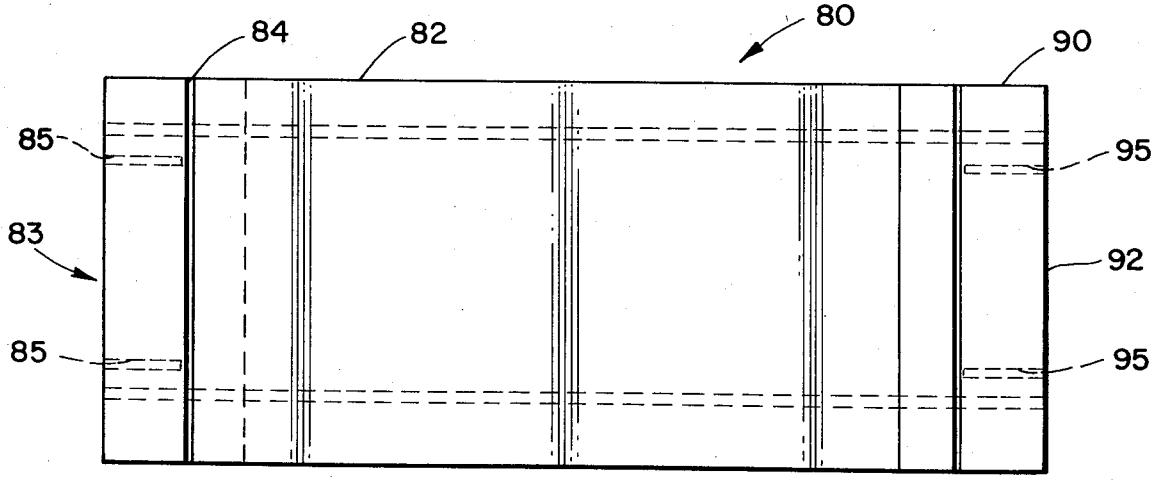
Figure 7B:
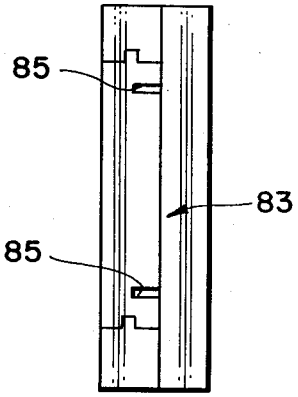
Figure 8:
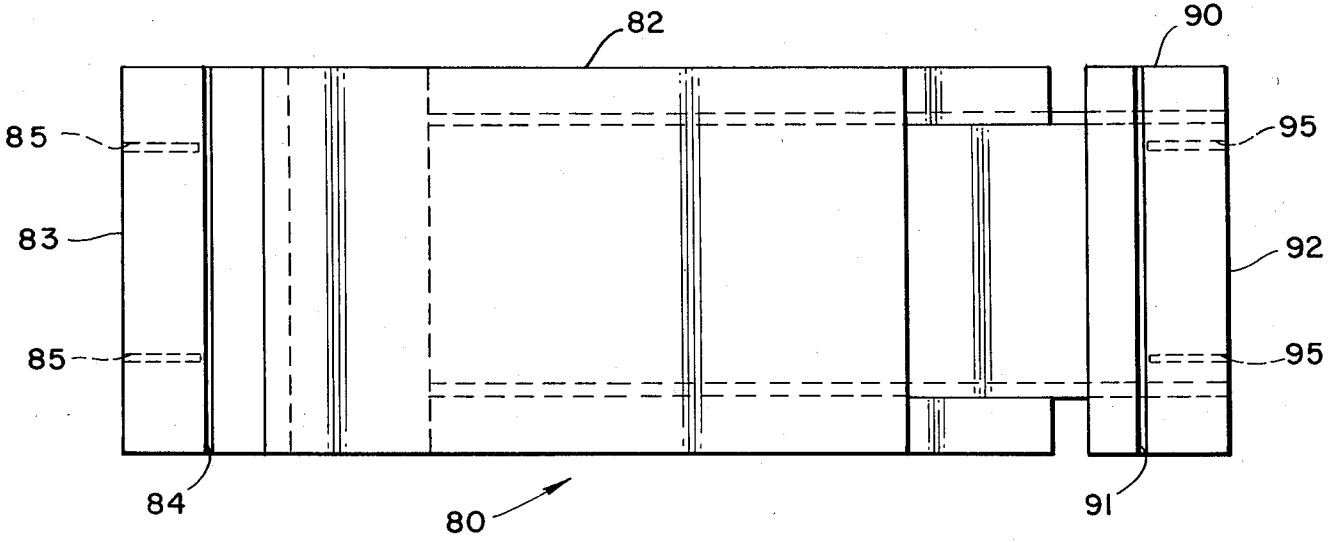
FIG. 8 is a side view of the wall surface face of the two piece frame and slide backing span according to the invention in slightly expanded position with the slide partially withdrawn from the frame for spanning variable spacing between metal studs.

An alternative embodiment of the blocking system according to the present invention is illustrated in FIGS. 7 and 8 using backing spans 80 composed of two backing elements 82 and 90 which may be linearly expanded and contracted relative to each other. Referring simultaneously to FIGS. 7, 7A, 7B, and 8, the backing element 82 comprises a rectangular frame formed at the end with a flat stud face 83 for abutting against the web of a metal stud and a kurfed groove 84 for accommodating the curled edge of the flange of the metal stud. The frame 82 is secured to the web of a metal stud in the manner, for example, heretofore described using steel pegs penetrating through the web of the metal stud and into the end of the frame 82 through peg holes 85.

With the first backing element for frame 82 secured to a metal stud, the second backing element 90 constructed as a drawer slideably supportable within the frame 82 may be drawn outward or slideably expanded laterally or horizontally relative to the frame 82 for spanning variable spaces between the adjacent metal studs. The second backing element or drawer 90 is formed at its end with a flat stud face 92 for abutting against the web of a metal stud and a kurfed groove 91 for accommodating the curled edge of the flange of a metal stud where necessary. The stud face 92 of the backing element or drawer 90 is secured to the adjacent metal stud by, for example, the steel metal studs as heretofore described penetrating the web of the metal stud and into the end of the drawer 90 into the peg holes 95.

The backing span 80 is thus composed of backing elements 82 and 90 constructed and arranged as a frame and drawer for linear expansion and contraction to span variable spacing between the metal studs. The backing span 80 presents a generally flat wall facing surface provided in major part by the flat side face of frame 82 as illustrated in FIGS. 7 and 8. Thus, the frame and drawer backing span provides the necessary structural surface for mounting fixtures to the wall and supporting other wall hung and wall supported items.

It is apparent that the blocking system according to the present invention can be implemented in a variety of configurations of expandable and contractable blocking spans composed of a plurality of blocking elements movable relative to each other for developing or resolving a lateral or horizontal component of motion for spanning variable spacing between studs in stud building projects. It is also apparent that the blocking system according to the invention is applicable not only to metal stud buildings but also stud frame construction using wood or other natural or synthetic materials. While the invention has been described with reference to particular example embodiments, it is intended to cover all modifications and equivalents within the scope of the following claims.

I claim:

1. A blocking system for metal stud buildings providing wall backing spans for support of wall-mounted fixtures between the metal wall studs comprising:

a plurality of expandable and retractable backing spans for placement and fitting between the studs, said backing spans being expandable and retractable for spanning variable spacing between the studs;

each backing span comprising a first backing element having a stud face for abutting against a web of a stud, and a second backing element for bearing against the first backing element, said first and second backing elements formed with continuously slideable complementary bearing surfaces, wherein the complementary bearing surfaces comprise inclined plane bearing surfaces, said second backing element being slideable relative to the first backing element along the complementary bearing surfaces with a component of motion in a lateral direction toward and away from a stud for expansion and retraction of the backing span to different spacing positions for spanning variable spacing between studs;

said first and second backing elements being constructed of penetrable material and arranged to cooperate and provide a vertical penetrable mounting face behind a wall surface for mounting and supporting fixtures on the wall at locations between studs;

and first securing means for securing the first backing element against the web of a stud.

2. The blocking system of claim 1 wherein each backing span further comprises a third backing element having a stud face for abutting against the web of an adjacent stud, said second and third backing elements formed with continuously slideable complementary bearing surfaces for bearing of the second backing element against the third backing element, said second backing element also being slideable relative to the third backing element along the complementary bearing surface with a component of motion in the lateral direction for expansion and retraction of the three backing elements relative to each other to different spacing positions for spanning variable spacing between studs;

said first, second, and third backing elements being constructed of penetrable material and arranged to cooperate and provide a vertical penetrable mounting face behind a wall surface for mounting and supporting fixtures on the wall at locations between studs;

and second securing means for securing the stud face of the third backing element against the web of a stud.

3. The blocking system of claim 1 wherein the first and second backing elements comprise complementary wedge shaped pieces with complementary wedge bearing surfaces.

4. The blocking system of claim 1 wherein the complementary bearing surfaces comprise inclined interfitting tongue and groove bearing surfaces.

5. The blocking system of claim 1 wherein the complementary bearing surfaces comprise inclined and beveled bearing surfaces.

6. The blocking system of claim 5 wherein the inclined and beveled bearing surfaces comprise double beveled bearing surfaces.

7. The blocking system of claim 2 wherein said first, second and third backing elements comprise wedge shaped pieces, said first and third backing elements comprising single-wedge shaped pieces, said second backing element comprising a double-wedge shaped piece fitting between the first and third backing elements.

8. The blocking system of claim 7 wherein the complementary bearing surfaces comprise inclined wedge bearing surfaces.

9. The blocking system of claim 8 wherein the inclined wedge bearing surfaces comprise interfitting tongue and groove bearing surfaces.

10. The blocking system of claim 8 wherein the inclined wedge bearing surfaces comprise complementary beveled bearing surfaces.

11. The blocking system of claim 1 wherein the second backing element of the backing span further comprises a stud face for abutting against the web of an adjacent stud;

and second means for securing the stud face of the second backing element against the web of an adjacent stud.

12. The blocking system of claim 11 wherein the first and second backing elements comprise wedge shaped pieces with inclined bearing surfaces.

13. The blocking system of claim 1 wherein the means for securing the first backing element against the web of a stud comprises peg means penetrating the stud and the first backing element abutting against the web of the stud, said peg means projecting from the other side of the stud for securing a backing element of another backing span against the other side of the web of the stud.

14. The blocking system of claim 2 wherein the first and third backing elements are formed with inclined bearing surfaces for defining between them a double-wedge shaped space when the first and third backing elements are secured abutting against facing webs of adjacent studs, and wherein the second backing element comprises a double-wedge shaped piece having a pair of inclined bearing surfaces for fitting securely into the double-wedge shaped space defined by the first and third backing elements.

15. The blocking system of claim 14 further comprising backing element coupling means for securing the backing elements together in a unitary backing span after placement of the double-wedge shaped second backing element between the first and third backing elements.

16. The blocking system of claim 1 further comprising backing element coupling means for securing the backing elements together in a unitary backing span after placement and fitting between studs.

17. The blocking system of claim 1 wherein the first backing element comprises a frame for abutting against and securing to the web of a stud;

and wherein the second backing element comprises slide means constructed and arranged in sliding and interfitting relationship to the frame so that the slide means may be pulled out and pushed in relative to the frame for expansion and retraction of the backing span.

18. The blocking system of claim 17 wherein the slide means is also formed with a stud face for abutting against the web of a stud facing the frame means.

19. A blocking system for metal stud buildings providing wall backing spans for support of wall-mounted fixtures between the metal wall studs comprising:

a plurality of expandable and retractable backing spans for placement and fitting between the studs and for spanning variable spacing between the studs;

each backing span comprising a first backing element having a stud face for abutting against a web of a stud, a second backing element against the first backing element, said first and second backing elements being formed with continuously slideable complementary bearing surfaces and being slideable relative to each other along the complementary bearing surfaces with a component of motion in a lateral direction toward and away from a stud for expansion and contraction of the backing span to different spacing positions, and a third backing element formed with a stud face for abutting against the web of an adjacent stud, said second backing element also bearing against the third backing element, said second and third backing elements being formed with continuously slideable complementary bearing surfaces and being slideable relative to each other along the complementary bearing surfaces with a component of motion in the lateral direction for expansion and contraction of the backing span to different spacing positions according to the variable spacing between the studs;

said first and third backing elements being formed with an inclined bearing surface and said second backing element formed with a pair of inclined bearing surfaces for positioning between the first and third backing elements;

said first, second, and third backing elements being constructed of penetrable material and arranged to cooperate and provide a vertical penetrable mounting face behind a wall surface for mounting and supporting fixtures on the wall at locations between studs;

first means for securing the first backing element with its stud face abutting against the web of a stud comprising first peg means penetrating through the stud and into the first backing element, said first peg means projecting from the stud on the opposite side from the first backing element for securing the backing element of another backing span against the other side of the web of the stud;

second means for securing the third backing element with its stud face abutting the web of a stud comprising second peg means penetrating through a stud facing the first backing element and penetrating into the third backing element, said second peg means projecting from the stud on the opposite side for securing the backing element of another backing span against the other side of the web of the stud;

and backing element coupling means securing the first, second, and third backing elements together in a unitary backing span at the selected spacing position after fitting the second backing element tightly between the first and third backing elements with the first, second, and third backing elements spanning the space between a pair of studs.

20. The blocking system of claim 19 wherein said first and third backing elements comprise wedge shaped pieces, each with an inclined bearing surface and wherein the second backing element comprises a double wedge shaped piece with a pair of inclined bearing surfaces.

21. The blocking system of claim 20 in which the complementary bearing surfaces comprise interfitting tongue and groove bearing surfaces.

22. The blocking system of claim 21 wherein the first and third blocking elements are formed with tongues or splines at the bearing surfaces and wherein the second backing element is formed with grooves in the bearing surfaces.

23. The blocking system of claim 21 wherein the first, second, and third backing elements are comprised of three plies of plywood with the center ply recessed to form grooves and the center ply projecting to form tongues or splines.

24. The blocking system of claim 20 wherein said first and third backing elements are formed with kurfed grooves on the sides for accommodating the curled edge of metal studs.

25. The blocking system of claim 22 wherein the backing element coupling means penetrates the tongues and grooves of the complementary bearing surfaces.

26. The blocking system of claim 25 wherein the backing element coupling means comprise screws.

27. The blocking system of claim 25 wherein the backing element coupling means comprise nails or pins.

28. The blocking system of claim 19 wherein the complementary bearing surfaces comprise complementary stepped bearing surfaces.

29. The blocking system of claim 28 wherein the complementary stepped bearing surfaces comprise complementary beveled stepped bearing surfaces.

30. The blocking system of claim 19 wherein the first and third backing elements are preformed with holes in the stud face of the backing elements for receiving the peg means.

31. The blocking system of claim 19 wherein second backing elements are provided with different width to accommodate different on-center spacing of the studs of a stud building.

32. The blocking system of claim 19 wherein said peg means comprise rectangular cross section steel pegs pointed at least at one end.

* * * * *